US007272351B2

(12) United States Patent
Murrell et al.

(10) Patent No.: US 7,272,351 B2
(45) Date of Patent: Sep. 18, 2007

(54) TRANSFER OF A MEDIA SHEET WITHIN AN IMAGE FORMING DEVICE

(75) Inventors: Niko Jay Murrell, Lexington, KY (US); Edward Lynn Triplett, Lexington, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 157 days.

(21) Appl. No.: 11/200,315

(22) Filed: Aug. 9, 2005

(65) Prior Publication Data

US 2007/0036593 A1 Feb. 15, 2007

(51) Int. Cl.
*G03G 15/16* (2006.01)

(52) U.S. Cl. ..... 399/316; 399/388

(58) Field of Classification Search ..... 399/316, 399/388, 390, 297, 303, 313; 271/225
See application file for complete search history.

(56) References Cited

U.S. PATENT DOCUMENTS

| | | | | |
|---|---|---|---|---|
| 4,842,574 | A | 6/1989 | Noble et al. | |
| 5,090,682 | A | 2/1992 | Takimoto | |
| 5,258,045 | A | 11/1993 | Yamashita | |
| 5,268,724 | A | 12/1993 | Koizumi et al. | |
| 5,276,489 | A * | 1/1994 | Kikuchi et al. | 399/316 |
| 5,455,663 | A * | 10/1995 | Inoue et al. | 399/303 |
| 5,533,720 | A | 7/1996 | Ahl et al. | |
| 5,594,539 | A * | 1/1997 | Murano et al. | 399/316 |
| 5,778,298 | A | 7/1998 | Enomoto et al. | |
| 5,787,330 | A * | 7/1998 | Funato | 399/390 |
| 6,055,409 | A | 4/2000 | Richards et al. | |
| 6,105,957 | A | 8/2000 | Miller et al. | |
| 6,145,834 | A | 11/2000 | Hirota et al. | |
| 6,198,903 | B1 | 3/2001 | Benedict | |
| 6,347,214 | B1 * | 2/2002 | Kaneko | 399/316 X |
| 6,644,655 | B2 | 11/2003 | Wurschum | |
| 6,796,559 | B2 | 9/2004 | Hirota et al. | |
| 2002/0146261 | A1 * | 10/2002 | Kanari et al. | 399/388 |
| 2004/0114974 | A1 * | 6/2004 | Sawai et al. | 399/316 |
| 2004/0253025 | A1 * | 12/2004 | Matsuura | 399/316 |
| 2004/0258439 | A1 * | 12/2004 | Izumi | 399/316 |

FOREIGN PATENT DOCUMENTS

| | | | |
|---|---|---|---|
| JP | 62-017776 | A * | 1/1987 |
| JP | 04-062575 | A * | 2/1992 |
| JP | 07-234593 | A * | 9/1995 |
| JP | 10-186904 | A * | 7/1998 |
| JP | 2001-083770 | A * | 3/2001 |

* cited by examiner

*Primary Examiner*—Sophia S. Chen
(74) *Attorney, Agent, or Firm*—Coats & Bennett, PLLC

(57) ABSTRACT

Devices and methods for directing a media sheet along a media path within an image forming apparatus. The media path includes rollers that form a media nip, one or more deflectors, and a transport belt. The media nip conveys the media sheet along the media path into one or more deflectors. The one or more deflectors are positioned between the nip and the transport belt. The one or more deflectors control the angle of the media sheet as it approaches the transport belt and facilitates attachment of the media sheet to the transport belt. The transport belt then moves the media sheet past one or more image forming units and receives a toner image.

19 Claims, 6 Drawing Sheets

TRANSFER OF A MEDIA SHEET WITHIN AN IMAGE FORMING DEVICE

BACKGROUND

Media sheets are moved along a media path during the image formation process. These sheets may be introduced from an input tray, or may be hand-fed by the user. The media path includes a plurality of elements that move the sheet from the input location, through the transfer area where toner is applied, and eventually out of the image forming device. Accurate movement of the media sheet through these elements along the media path is important for good image formation.

The media path may include different types of media movement elements. These elements may include media nips and media belts. The media nip is formed between a pair of contacted rollers. The media sheet is gripped in the nip by the rollers and driven along the media path as the rollers are rotating. The media belt is an elongated belt that extends around two or more supports. The media sheets are placed on a surface of the belt and are moved along the media path as the belt moves around the supports.

It is important that the media sheet be accurately moved during the hand-off or transfer between a media nip and a media belt. The speed of the media sheet should be accurately controlled during the handoff. Further, the location of the media sheet should be accurately tracked during the hand-off. The media sheet should not slip or otherwise become misaligned during the handoff. Also, the handoff should not cause the media sheet to become jammed within the media path. A jammed sheet may result in the media sheet being destroyed, and the image forming process being stopped. Further, the user is required to locate the jam, remove the jammed media sheet, and reset the device prior to restart.

SUMMARY

The present application is directed to embodiments to transfer a media sheet along a media path. In one embodiment, the transfer occurs between a media nip and a media belt. One or more deflectors are positioned between the media nip and a transfer section on the media belt. The media sheet is moved through the nip and is deflected by the one or more deflectors. The media sheet is than directed towards the media belt where the media sheet is then carried through an image forming section and receives a toner image.

DETAILED DESCRIPTION

Figure 1:
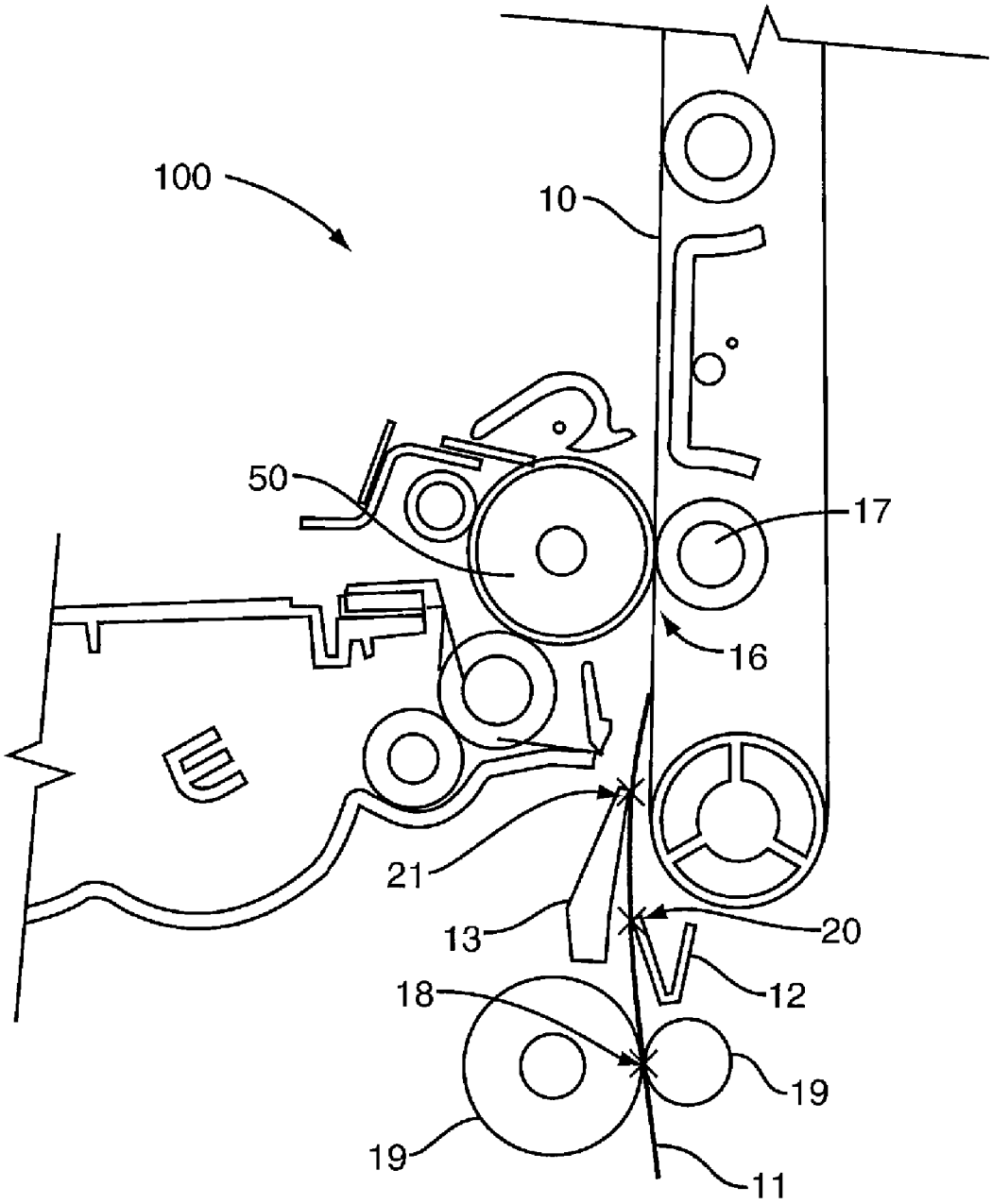
FIG. 1 is a schematic view of a section of the media path according to one embodiment of the present invention.

The present application is directed to a device and methods for directing a media sheet within an image forming apparatus. FIG. 1 illustrates one embodiment of the image forming apparatus having a media path. The media path comprises a media nip 18 formed by rollers 19, deflectors 12, 13, and a transport belt 10. The media nip 18 conveys the media sheet 11 along the media path into the first deflector 12 that directs the media sheet 11 into the second deflector 13 and finally onto the transport belt 10. The deflectors 12, 13 positioned between the nip 18 and transport belt 10 control the angle of the media sheet 11 as it approaches the transport belt 10 and facilitates attachment of the media sheet 11 to the transport belt 10. The transport belt 10 then moves the media sheet 11 past one or more image forming units 100.

Figure 2:
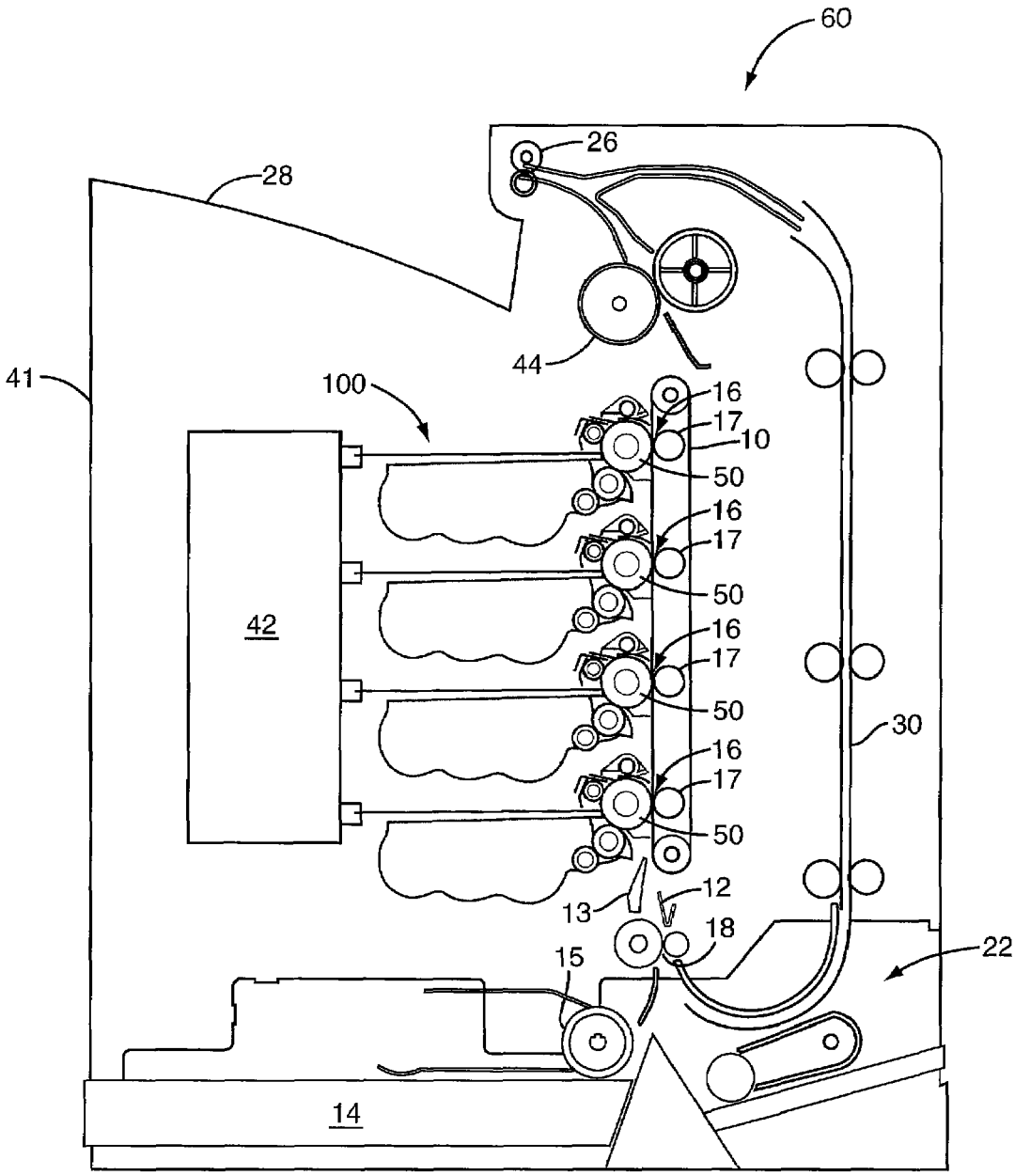
FIG. 2 is a schematic view of an image forming device according to one embodiment of the present invention.

A better understanding of the embodiments is facilitated by a general overview of the media path of the image forming device. FIG. 2 illustrates one embodiment of an image forming device, such as a laser printer, indicated generally by the numeral 60. The terms "image forming device" and "image forming apparatus" are used interchangeably throughout the application. The image forming device 60 comprises a main body 41. A media tray 14 with a pick mechanism 15 or a manual input 22 provide conduits for introducing media sheets 11 into the device 60. The conduits may be located on a lower section of the device 60.

The media sheet 11 is moved from the input and fed into a primary media path. The media path includes the media nip 18, deflectors 12, 13, and the transport belt 10. The transport belt 10 extends around two or more supports to move the media sheet 11 past at least one image forming unit 100. The media sheet 11 may be electrostatically tacked to the belt 10. This ensures that the media sheet 11 does not slip as it moves along the belt and past the image forming units 100.

Color image forming devices typically include four image forming units 100 for printing with cyan, magenta, yellow, and black toner to produce a four color image on the media sheet 11. An imaging device 42 forms an electrical charge on a photoconductive (PC) member 50 within the image forming units 100 as part of the image formation process. The transport belt 10 moves the media sheet 11 through an image transfer section 16 formed between the PC member 50 and a transfer roller 17. The toner is transported from the PC member 50 towards the transfer roller 17 and intercepted by the media sheet 11. The media sheet 11 moves through each of the image transfer sections 16 and gathers toner layers from one or more image forming units 100. The media sheet 11 with loose toner is then moved through a fuser 44 that adheres the toner to the media sheet 11. Exit rollers 26 rotating in a first direction drive the media sheet 11 into an output tray 28. The exit rollers 26 may also rotate in a second direction to drive the media sheet 11 back into the device 60 and along a duplex path 30 for image formation on a second side of the media sheet 11.

The image forming device 60 is generally vertically aligned as the media sheets 11 are input at a lower section of the main body 41 and are output at an upper section. The four image forming units 100 are stacked on top of each other in the vertical direction. Further, the media path vertically moves the media sheets through the device 60.

Returning to the specifics of the present application, FIG. 1 illustrates one embodiment. A first deflector 12 and second deflector 13 are positioned between the media nip 18 and transport belt 10. The media nip 18 is positioned vertically below the deflectors 12, 13, and the transport belt 10. The media nip 18 is generally aligned in the same plane as the belt 10 and image transfer section 16. The first deflector 12 has a contact point 20 where it is contacted by the media sheet 11, and the second deflector 13 has a second contact point 21. The media sheet 11 moves through the nip 18 and contacts the first deflector 12 at point 20, and the second deflector 13 at point 21. Contact point 21 is immediately adjacent to the belt 10 and the media sheet 11 is then directed to the belt 10 for further movement through the image transfer section 16.

The deflectors 12, 13 are positioned to form an arc in the media sheet 11 as it passes from the media nip 18 to the belt 10. This arc causes the media sheet 11 to approach the belt 10 at an angle to allow for electrostatic tacking to hold the media sheet 11 to the belt 10. If the media sheet 11 were to move within the plane defined by the media nip 18 and belt 10, the angle of approach of the media sheet relative to the belt 10 may be too small and there may not be enough contact between the media sheet 11 and belt 10 for attachment. Additionally, the vertical architecture does not cause gravity to press the media sheet 11 against the belt 10 as it would on a horizontal architecture.

The sheet 11 is held on the belt 10 by electrostatic tacking and moved a distance prior to moving through first transfer section 16. The approach angle of the media sheet is set to allow for contact between the surface of the sheet 11 and the belt 10. Without an adequate approach angle, there may not be enough contact between the sheet 11 and belt 10 for electrostatic tacking. This would results in the media sheet 11 slipping as it moves along the belt 10, or even falling from the belt 10.

The embodiment illustrated in FIG. 1 includes the first and second contact points 20, 21 both being out of the plane and on the same side of the plane (i.e., to the left of the plane as illustrated in FIG. 1). The media sheet 11 moves through the media nip 18 and is directed out of the plane to contact deflector 12. The media sheet 11 is then directed further out of the plane towards deflector 13. The second deflector 13 and second contact point 21 direct the media sheet 11 back towards the plane where it then contacts the belt 10 at a steeper approach angle then if the media sheet 11 moved directly from the media nip 18.

Figure 3:
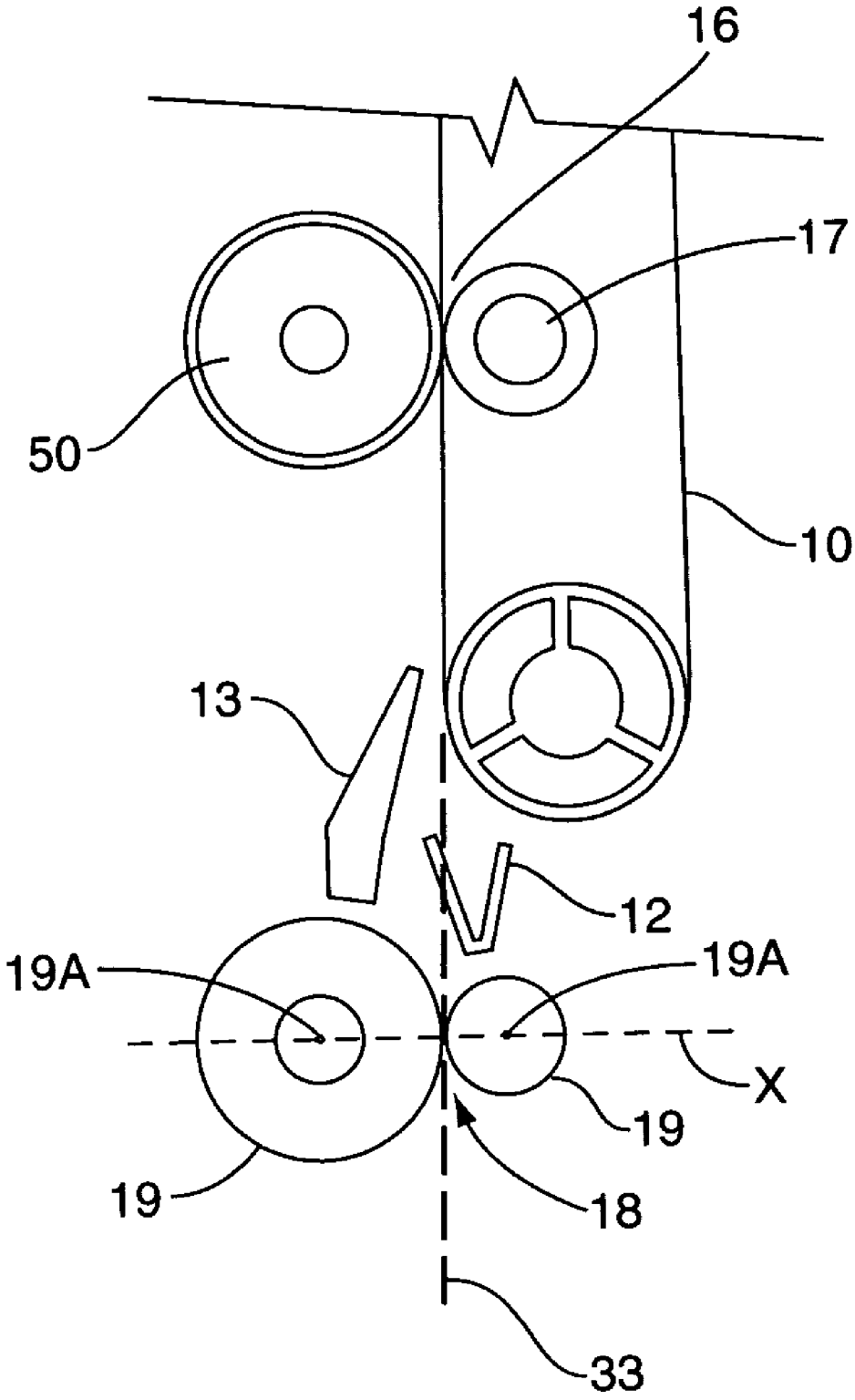
FIG. 3 is a schematic view of a section of the media path according to one embodiment of the present invention.
Figure 4:
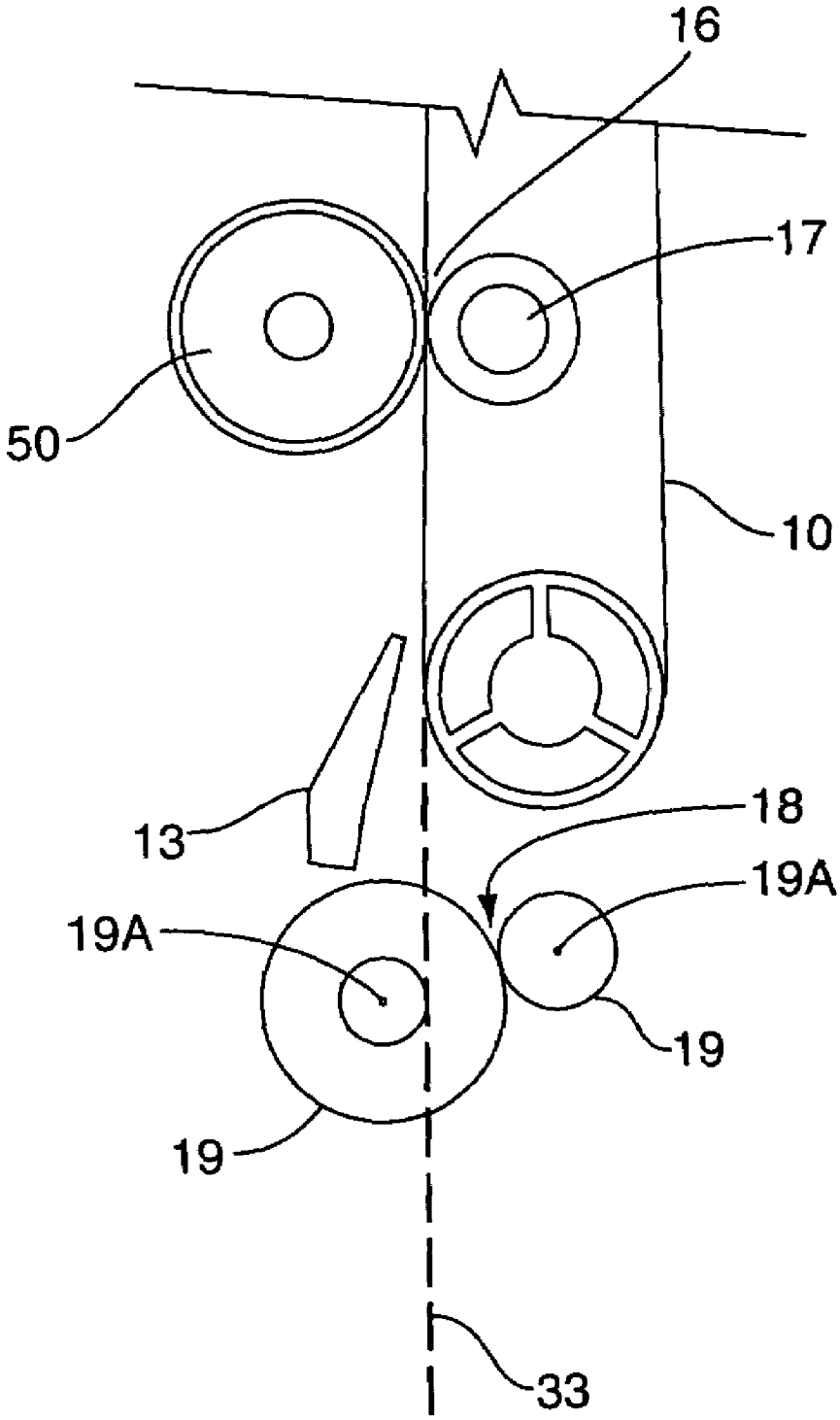
FIG. 4 is a schematic view of a section of the media path according to one embodiment of the present invention.
Figure 5:
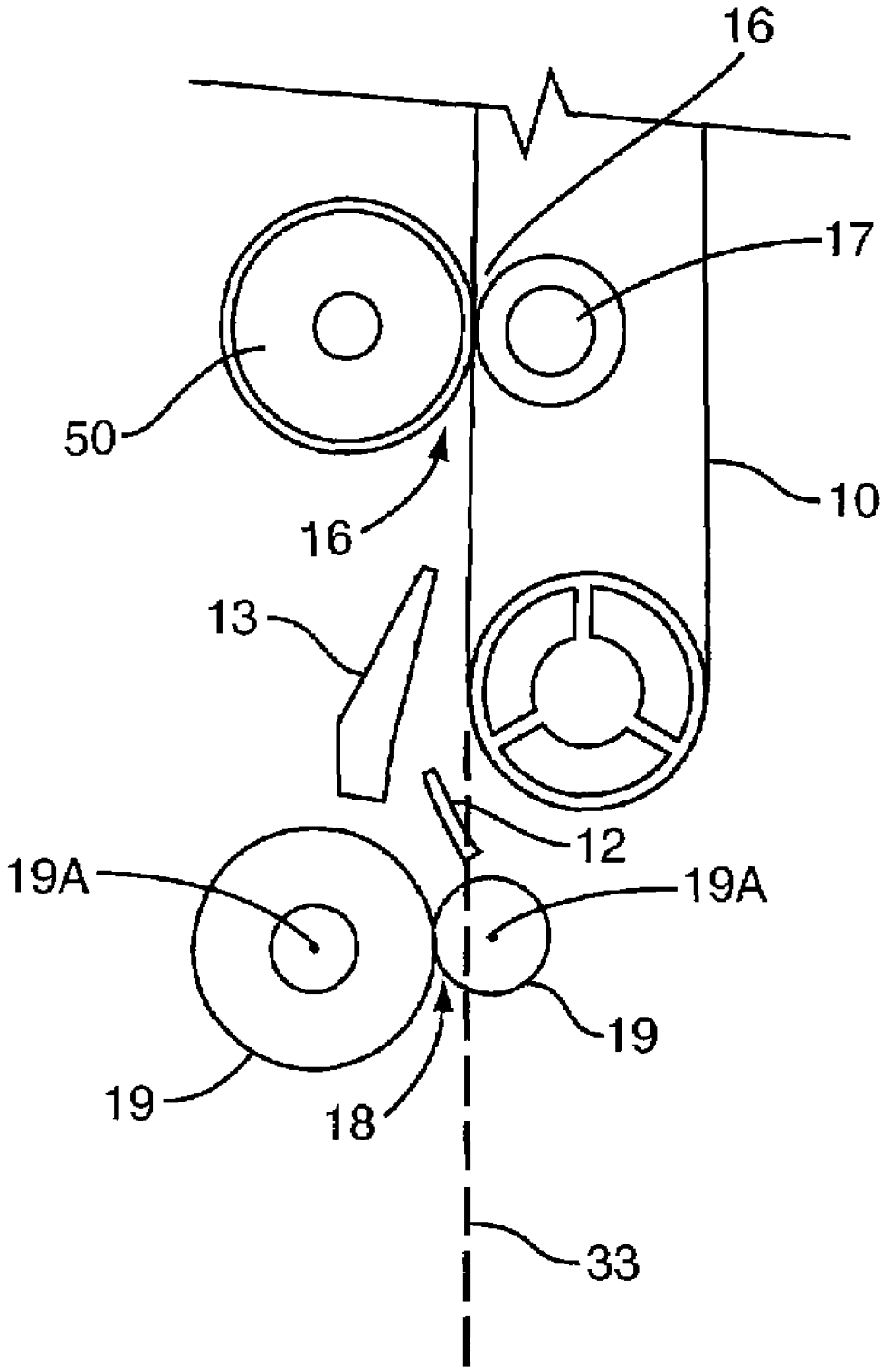
FIG. 5 is a schematic view of a section of the media path according to one embodiment of the present invention.

In the embodiment illustrated in FIG. 3, the plane of the belt 10 is positioned between the centers 19A of rollers 19 that form the media nip 18. In the embodiment of FIG. 3, the media nip 18 is positioned exactly on the plane, which is shown by the dotted line 33 that extends outward from the belt 10. In other embodiments, the media nip 18 may be positioned out of the plane 33. FIG. 4 illustrates an embodiment with the nip 18 positioned on a first side of the plane 33. FIG. 5 illustrates an embodiment with the nip 18 positioned on an opposite side of the plane 33.

Figure 6:
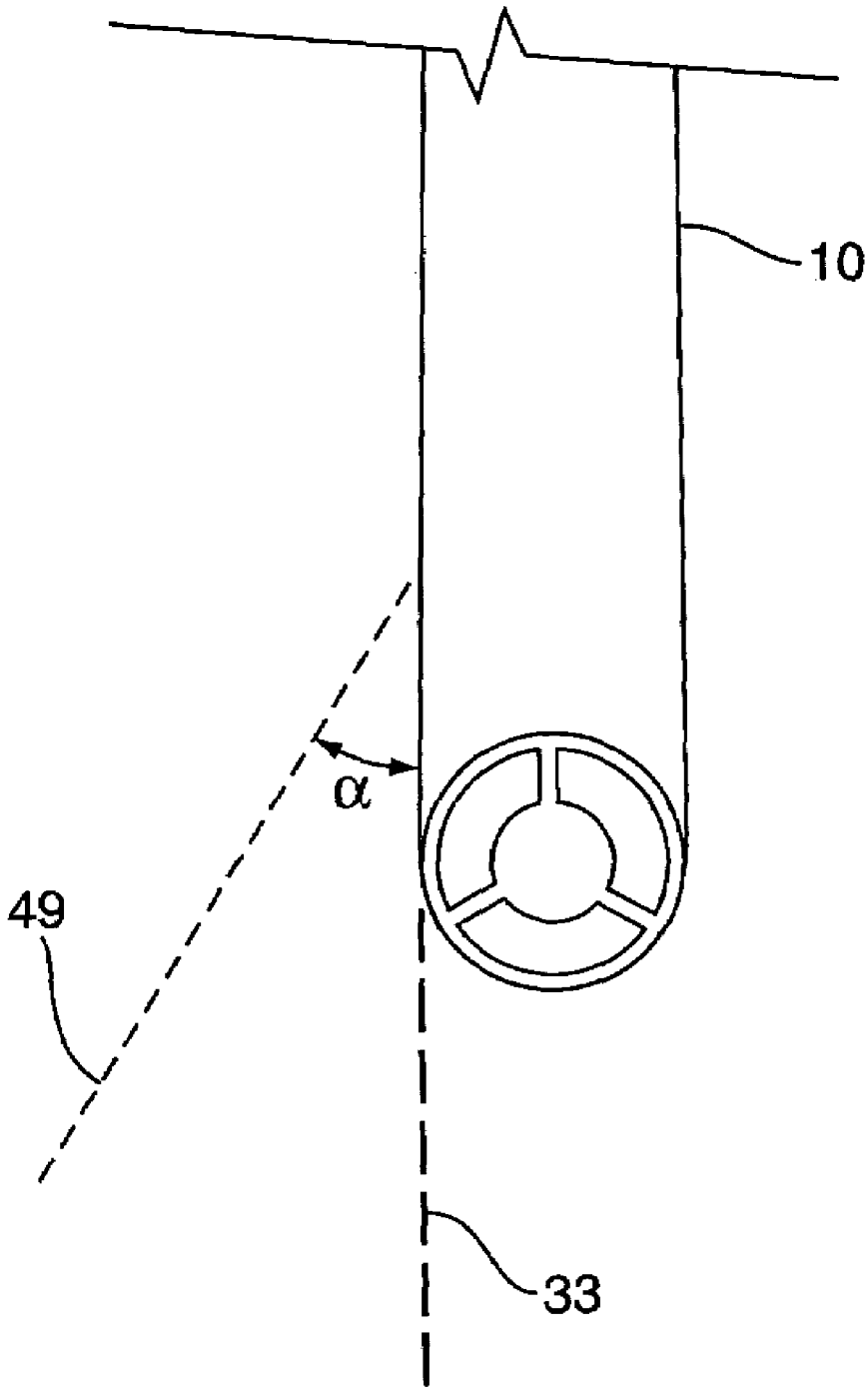
FIG. 6 is a schematic view of a section of the media path according to one embodiment of the present invention.

FIG. 6 illustrates a schematic representation of the approach angle $\alpha$ defined by the approach line 49 of the media sheet and the plane 33 of the belt 10. The media nip 18 in combination with the one or more deflectors 12, 13 position the media sheet 11 away from the transport belt 10. The media sheet 11 is than directed to contact the belt 10 at the angle $\alpha$. The approach angle $\alpha$ may be in the range of between about 10°-80°. In one specific embodiment, the approach angle $\alpha$ is about 45°. Without the use of deflectors 12, 13, and with the media nip 18 positioned in the plane 33 formed by the belt 10, the approach angle would be about 0°. It has been determined that this approach may be inadequate to attach the media sheet 11 to the belt 10.

The media path includes one or more deflectors 12, 13. The deflectors 12, 13 may have a variety of shapes and sizes depending upon the structure of the media path. Each deflector 12, 13 includes a contact surface facing the media path that is contact by the media sheet 11 as it moves from the media nip 18. The contact surface is aligned transverse to the plane formed by the belt 10. One or both deflectors 12, 13 may extend across the plane, or may be spaced away from the plane. By way of example and using the embodiment of FIG. 3, deflector 12 extends into the plane, and deflector 13 is spaced away from the plane.

The media nip 18 is formed by a pair of opposing rollers 19. One of the rollers 19 may be operatively connected to a motor that provides rotational power. The second roller 19 is driven by the contact with the drive roller. In one embodiment, the rollers 19 may rotate in both forward and reverse directions. In one process, the rollers 19 are either rotating in a reverse direction or are stationary at the time that the leading edge of the media sheets 11 makes contact. As the media sheet continues to be driven in a forward direction as the leading edge is held, a buckle is formed in the media sheet upstream from the media nip 18 that causes the leading edge to become laterally aligned. The rollers 19 are then rotated in a forward direction and the media sheet 11 moves through the media path.

The rollers 19 may be positioned at a variety of relative positions. In one embodiment as illustrated in FIG. 3, the rollers 19 are aligned in a side-by-side orientation. A line X drawn through the roller centers 19A is substantially perpendicular with the plane of the belt 10. In this orientation, the media sheet 11 is moved generally parallel to the plane of the belt 10. Rollers 19 may also be angled. FIG. 4 illustrates an embodiment with the rollers 19 aligned at an angular orientation. In this embodiment, the media sheet 11 is directed through the nip 18 towards the plane of the belt 10.

The embodiments of the present application may also be used in an image forming device 60 having a horizontal orientation. The horizontal orientation has a media path that is aligned substantially in a horizontal direction. Examples of a horizontal orientation include laser printer Model Nos. C-750 and C-752, each from Lexmark International, Inc. of Lexington, Ky.

The present invention may be carried out in other specific ways than those herein set forth without departing from the scope and essential characteristics of the invention. The deflectors 12, 13 may be statically positioned, or may be movable. The present embodiments are, therefore, to be considered in all respects as illustrative and not restrictive, and all changes coming within the meaning and equivalency range of the appended claims are intended to be embraced therein.

What is claimed is:

1. A device to direct a media sheet within an image forming apparatus comprising:

a transport belt passing through an image transfer section, the transport belt defining a plane;

a nip positioned upstream from the transport belt along a media path and positioned on the plane, the nip is formed by first and second rolls with the first roll angularly offset from the second roll to direct the media sheet out of the plane; and a deflector positioned along the media path between the nip and the image transfer section, the deflector positioned out of the plane;

the nip driving the media sheet away from the plane to contact the deflector which then directs the media sheet back towards the plane to contact the belt at a point upstream from the image transfer section.

2. The device of claim 1, wherein the nip is immediately adjacent to the deflector.

3. The device of claim 2, wherein the deflector is immediately adjacent to the transport belt.

4. The device of claim 1, further comprising a second deflector positioned on an opposite side of the plane from the deflector, the second deflector being positioned between the nip and the transport belt.

5. The device of claim 1, wherein the plane is vertically aligned within the image forming apparatus.

6. The device of claim 1, wherein a contact point of the deflector is positioned between an end of the belt and the image transfer section.

7. The device of claim 1, wherein a line drawn through a center of rollers that form the nip is substantially perpendicular to the plane.

8. A device to direct a media sheet within an image forming apparatus comprising:

a transport belt having a first end and a second end, the transport belt having a vertical orientation;

an image transfer section positioned along the belt and between the first and second ends;

a nip upstream from the image transfer section and positioned vertically below the first end of the transport belt; and a deflector positioned downstream from the nip to direct the media sheet toward the belt at a point upstream from the image transfer section.

9. The device of claim 8, wherein the image transfer section comprises a transfer nip formed between a photoconductive member and a transfer roll, the transfer nip being distanced away from the first end of the transport belt.

10. The device of claim 8, wherein the nip is generally within a plane defined by the transport belt.

11. The device of claim 8, further comprising a fuser positioned vertically above the second end of the transport belt.

12. The device of claim 8, further comprising an input section positioned vertically below the nip and an output section vertically above the second end of the transport belt.

13. The device of claim 8, further comprising a second deflector, the second deflector positioned between the nip and the deflector to contact the media sheet as it moves out of the nip and direct the media sheet towards the deflector.

14. A method of directing a media sheet within an image forming apparatus, the method comprising the steps of:

vertically driving the media sheet upward through a nip in a direction that is out of alignment with a transport belt;

deflecting the media sheet that has passed through the nip in a direction towards the transport belt;

attaching the media sheet to the belt; and vertically moving the media sheet on the belt through at least one image forming section and forming a toner image on the media sheet.

15. The method of claim 14, further comprising forming an arc in the media sheet after it passes through the nip.

16. The method of claim 14, further comprising deflecting the media sheet a second time after passing through the nip and before contacting the transport belt.

17. The method of claim 14, further comprising electrostatically tacking the media sheet to the belt prior to moving the media sheet through the at least one image forming section.

18. The method of claim 14, further comprising moving the media sheet with the toner image vertically through a fuser and adhering the toner image to the media sheet.

19. The method of claim 18, further comprising inputting the media sheet from an input positioned vertically below the nip.

* * * * *